US009126418B2

(12) United States Patent
Miyazawa

(10) Patent No.: US 9,126,418 B2
(45) Date of Patent: Sep. 8, 2015

(54) PRINTING APPARATUS

(71) Applicant: Seiko Epson Corporation, Tokyo (JP)

(72) Inventor: Makoto Miyazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/464,308

(22) Filed: Aug. 20, 2014

(65) Prior Publication Data

US 2015/0062209 A1 Mar. 5, 2015

(30) Foreign Application Priority Data

Aug. 30, 2013 (JP) ..... 2013-179754

(51) Int. Cl.
*B41J 29/393* (2006.01)
*B41J 2/175* (2006.01)

(52) U.S. Cl.
CPC ..... *B41J 2/17566* (2013.01)

(58) Field of Classification Search
CPC ..... B41J 2/17546
See application file for complete search history.

(56) References Cited

U.S. PATENT DOCUMENTS 6,385,407 B1 * 5/2002 Inose ..... 399/24
6,672,695 B1 * 1/2004 Naka et al. ..... 347/7
6,996,347 B2 2/2006 Ito et al.
8,544,980 B2 10/2013 Miyazawa

FOREIGN PATENT DOCUMENTS

JP 2004-227012 A 8/2004
JP 2012-006229 A 1/2012

* cited by examiner

*Primary Examiner* — Julian Huffman

(57) ABSTRACT

A printing apparatus 100 is capable of mounting a multi-color printing material container having a storage device that stores identification information of the printing material container and ink consumption information of each color. The printing apparatus includes a first nonvolatile memory 120 that stores the identification information of printing material containers and first usage information that is based on the ink consumption information of each color, and a printing apparatus controller 110 that performs control of print processing. The printing apparatus controller executes storage device error processing in the case where the relation between usage information on the printing material container side that is based on the ink consumption information of each color read from storage devices 310 and 320 and first usage information associated with identification information that is the same as the identification information of the printing material containers that are mounted does not satisfy a preset relation.

11 Claims, 12 Drawing Sheets

FIG. 2A

| | (1) | (2) | (3) |
|---|---|---|---|
| INK CONSUMPTION (C) | 30 % | 5 % | 60 % |
| INK CONSUMPTION (M) | 20 % | 15 % | 50 % |
| INK CONSUMPTION (Y) | 15 % | 10 % | 70 % |
| USAGE INFORMATION | 30 % | 15 % | 70 % |

FIG. 2B

| | (1) | (2) | (3) |
|---|---|---|---|
| INK CONSUMPTION (C) | 30 % | 5 % | 60 % |
| INK CONSUMPTION (M) | 20 % | 15 % | 50 % |
| INK CONSUMPTION (Y) | 15 % | 10 % | 70 % |
| USAGE INFORMATION | 15 % | 5 % | 50 % |

FIG. 2C

| | (1) | (2) | (3) |
|---|---|---|---|
| INK CONSUMPTION (C) | 30 % | 5 % | 60 % |
| INK CONSUMPTION (M) | 20 % | 15 % | 50 % |
| INK CONSUMPTION (Y) | 15 % | 10 % | 70 % |
| USAGE INFORMATION | 65 % | 30 % | 180 % |

FIG. 2D

| | (1) | (2) | (3) |
|---|---|---|---|
| INK CONSUMPTION (C) | 30 % | 5 % | 60 % |
| INK CONSUMPTION (M) | 20 % | 15 % | 50 % |
| INK CONSUMPTION (Y) | 15 % | 10 % | 70 % |
| USAGE INFORMATION | C 30 % | M 15 % | Y 70 % |

PRINTING APPARATUS

BACKGROUND

1 . Technical Field

The present invention relates to printing apparatuses and the like.

2 . Related Art

In recent years, printing material containers (cartridges) for a printing apparatus that are equipped with a storage device for storing ink-related information (for example, ink consumption), identification information about the printing material container and the like have been used. However, when a memory error occurs in the storage device of a printing material container, the printing apparatus might not be able to correctly perform processing relating to the printing material container (for example, calculation of ink consumption; determination of the need to replace the printing material container).

In response to this problem, JP-A-2012-6229 , for example, discloses a technique that enables appropriate measures to be taken in the case where a fault occurs in circuitry including the storage device of a printing material container, and that also utilizes the identification information stored in the storage device of printing material containers to correctly determines whether a new printing material container has been mounted.

However, there are problems with this technique such as difficulty in achieving efficient error checking with printing apparatuses that use multi-color integrated printing material containers.

SUMMARY

An advantage of some aspects of the invention is to provide a printing apparatus or the like that is capable of mounting a multi-color integrated printing material container, and is able to perform efficient error processing of a storage device provided in a printing material container.

An aspect of the invention relates to a printing apparatus capable of mounting a multi-color integrated printing material container having a storage device that stores identification information of the printing material container and ink consumption information of each color. The printing apparatus includes a first nonvolatile memory that stores the identification information of printing material containers that have been mounted in the printing apparatus and first usage information that is based on the ink consumption information of each color of the printing material containers, and a printing apparatus controller that controls print processing. The printing apparatus controller compares usage information on the printing material container side that is based on the ink consumption information of each color read from the storage device of a printing material container that is mounted in the printing apparatus with the first usage information associated with identification information that is the same as the identification information of the printing material container that is mounted in the printing apparatus, and executes error processing of the storage device of the printing material container, in a case where a relation between the usage information on the printing material container side and the first usage information does not satisfy a preset relation.

According to this aspect of the invention, printing material containers can be miniaturized because of being able to mount a multi-color integrated printing material container, enabling a printing apparatus that is compact and portable to be realized as a result. Also, because error processing of the storage device of the printing material container can be executed in the case where the relation between usage information on the printing material container side and first usage information does not satisfy a preset relation, a storage device error can be reliably detected and dealt with. As a result, it is possible for the reliability of print processing to be enhanced and the like.

Also, in an aspect of the invention, the printing apparatus may further include a second nonvolatile memory. The second nonvolatile memory may store the identification information and the ink consumption information of each color of printing material containers that were mounted in the printing apparatus when the printing apparatus was last powered off or before a printing material container was replaced, and the printing apparatus controller, in a case where the identification information stored in the second nonvolatile memory and the identification information read from the storage device of the printing material container that is currently mounted do not match, and second usage information that is based on the ink consumption information of each color stored in the second nonvolatile memory satisfies a predetermined condition, may perform processing for additionally writing the identification information and the second usage information that are stored in the second nonvolatile memory to the first nonvolatile memory.

With this configuration, additional writing of identification information and second usage information to the first nonvolatile memory can be performed only in the case where the second usage information satisfies a predetermined condition, thus enabling the amount of information that is stored in the first nonvolatile memory to be reduced.

Also, in an aspect of the invention, the printing apparatus controller, in a case where identification information that is the same as the identification information stored in the second nonvolatile memory is stored in the first nonvolatile memory, may compare the second usage information with the first usage information associated with the same identification information stored in the first nonvolatile memory, and judge, based on a result of the comparison, whether to perform additional writing of the identification information and the second usage information that are stored in the second nonvolatile memory to the first nonvolatile memory.

With this configuration, the storage capacity of the first nonvolatile memory can be reduced because of being able to further reduce the amount of information that is stored in the first nonvolatile memory, thus enabling costs to be reduced and the like as a result.

Also, in an aspect of the invention, the first nonvolatile memory may store, as the first usage information, the ink consumption information of the color having the largest ink consumption among the ink consumption information of each color of the printing material container, and the second usage information that is based on the ink consumption information of each color stored in the second nonvolatile memory may be the ink consumption information of the color having the largest ink consumption among the ink consumption information of each color.

With this configuration, the amount of information that is stored in the first nonvolatile memory can be further minimized.

Also, in an aspect of the invention, the first nonvolatile memory may store, as the first usage information, the ink consumption information of the color having the smallest ink consumption among the ink consumption information of each color of the printing material container, and the second usage information that is based on the ink consumption information of each color stored in the second nonvolatile memory may be the ink consumption information of the color having the smallest ink consumption among the ink consumption information of each color.

With this configuration, the amount of information that is stored in the first nonvolatile memory can be further minimized.

Also, in an aspect of the invention, the first nonvolatile memory may store, as the first usage information, information regarding a total ink consumption of the ink consumptions of the colors of the printing material container, and the second usage information that is based on the ink consumption information of each color stored in the second nonvolatile memory may be the information regarding the total ink consumption of the ink consumptions of the colors.

With this configuration, the amount of information that is stored in the first nonvolatile memory can be further minimized.

Also, in an aspect of the invention, the first nonvolatile memory may store, as the first usage information, color information of a color having the largest ink consumption and ink consumption information of the color among the ink consumption information of each color of the printing material container, and the second usage information that is based on the ink consumption information of each color stored in the second nonvolatile memory may be the ink consumption information corresponding to the color of the color information stored in the first nonvolatile memory.

With this configuration, the amount of information that is stored in the first nonvolatile memory can be further minimized.

Also, in an aspect of the invention, the printing apparatus controller may perform the error processing of the storage device of the printing material container before starting a printing operation, when returning from power saving mode, or after replacing a printing material container.

With this configuration, storage device error processing can be executed before starting a printing operation, when returning from power saving mode, or after replacing a printing material container, thus enabling the reliability of print processing to be enhanced and the like. Additional writing to the first nonvolatile memory can also be performed at this time.

Also, in an aspect of the invention, the printing apparatus controller may judge that the relation between the usage information on the printing material container side and the first usage information does not satisfy the preset relation in a case where the ink consumption that is based on the usage information on the printing material container side is smaller than the ink consumption that is based on the first usage information, and execute the error processing of the storage device.

With this configuration, errors in ink consumption information stored in the storage device can be reliably detected.

Also, in an aspect of the invention, the printing apparatus controller may compare the usage information on the printing material container side with the second usage information that is based on the ink consumption information of each color stored in the second nonvolatile memory, and execute the error processing of the storage device in a case where the ink consumption that is based on the usage information on the printing material container side is smaller than the ink consumption that is based on the second usage information.

With this configuration, errors in ink consumption information stored in the storage device can be even more reliably detected.

Also, in an aspect of the invention, the printing apparatus controller may perform writing for updating the ink consumption information of each color to the storage device of the printing material container at a higher frequency than a frequency at which the identification information and the usage information are written to the first nonvolatile memory.

With this configuration, the amount of information that is stored in the first nonvolatile memory can be further minimized because of being able to reduce the frequency at which identification information and usage information are written to the first nonvolatile memory.

BRIEF DESCRIPTION OF THE DRAWINGS

The invention will be described with reference to the accompanying drawings, wherein like numbers reference like elements.

FIGS. 2A to 2D illustrate usage information in first to fourth exemplary configurations of the printing apparatus.

DESCRIPTION OF EXEMPLARY EMBODIMENTS

Hereinafter, preferred embodiments of the invention will be described in detail. Note that the embodiments described below are not intended to unduly limit the scope of the invention as defined in the claims, and not all combinations of the features described in the embodiments are essential to means for solving the problems addressed by the invention.

1 . Printing Apparatus

Figure 1:
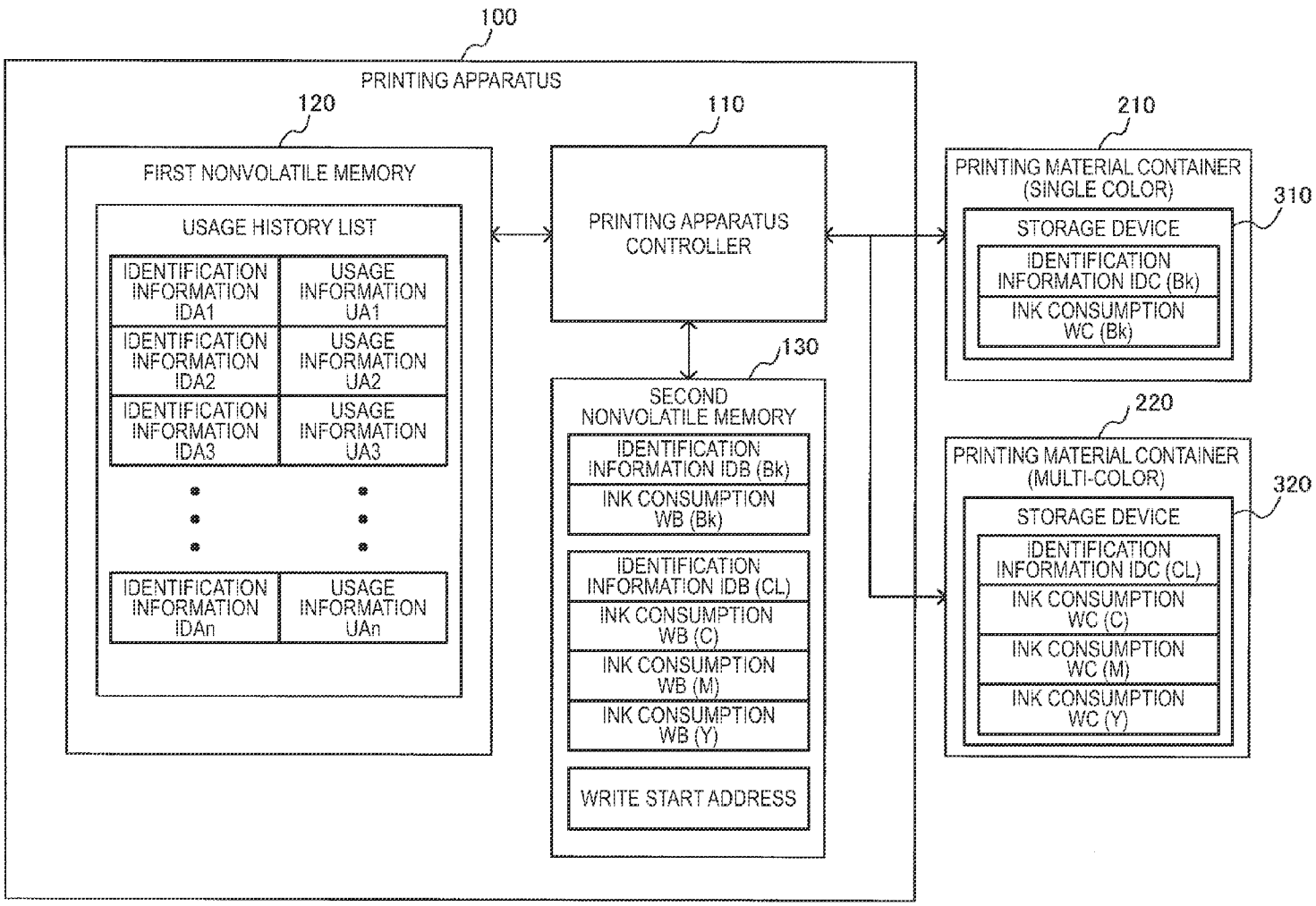
FIG. 1 shows an exemplary basic configuration of a printing apparatus.

FIG. 1 shows a basic exemplary configuration of a printing apparatus 100 of the present embodiment. The printing apparatus 100 of the present embodiment includes a printing apparatus controller 110, a first nonvolatile memory 120, and a second nonvolatile memory 130. Note that the printing apparatus 100 of the present embodiment is not limited to the configuration of FIG. 1, and various modification can be implemented, such as omitting some of the above constituent elements, replacing them with other constituent elements, or adding other constituent elements.

The printing apparatus 100 is a printing apparatus capable of mounting a multi-color integrated printing material container. For example, the printing apparatus 100 shown in FIG. 1 is able to mount a single color printing material container 210 and a multi-color integrated printing material container 220. The single color printing material container 210 holds black ink (Bk), for example. The multi-color integrated printing material container 220 holds ink of the three colors cyan (C), magenta (M) and yellow (Y), for example. The single color printing material container 210 and the multi-color integrated printing material container 220 are consumables that are replaceable in the case where the ink held therein is consumed. Hereinafter, the printing material containers are also referred to as "ink printing material containers" or simply "printing material containers".

The printing material containers 210 and 220 respectively have storage devices 310 and 320 that store identification information IDC of the printing material container and ink consumption information WC for each color. For example, the storage device 310 of the single color printing material container 210 stores identification information IDC(Bk) of the printing material container 210 and ink consumption information WC(Bk) for ink of the color black (Bk). Also, the storage device 320 of the multi-color integrated printing material container 220 stores identification information IDC (CL) of the printing material container 220, and ink consumption information WC(C), WC(M), and WC(Y) for ink of the colors cyan (C), magenta (M) and yellow (Y). The storage devices 310 and 320 can be constituted by nonvolatile memories such as flash memory or EEPROM.

The identification information IDC is unique information (unique ID) that is able to uniquely identify a printing material container. The ink consumption information WC is information relating to consumption of ink held in a printing material container, and represents ink consumption as being 0% in the case of an unused printing material container and 100% in the case where ink held in the printing material container has been completely used, for example.

The printing apparatus controller 110 performs control required for print processing such as carriage control and print head control. Also, the printing apparatus controller 110 performs processing for counting the amount of ink of each color that is consumed in processing such as printing or print head cleaning, and writing the ink consumption information WC to the storage devices 310 and 320 of the printing material containers 210 and 220 based on the counted amount of ink consumption. Also, the printing apparatus controller 110 performs processing for writing the identification information and usage information of the printing material containers to a usage history list that is stored in the first nonvolatile memory 120, and processing for writing the identification information of the printing material containers and the ink consumption information of each color to the second nonvolatile memory 130. Furthermore, the printing apparatus controller 110 performs error processing of the storage devices 310 and 320 of the printing material containers 210 and 220. The details of the write processing to the first and second nonvolatile memory 120 and 130 and the error processing of the storage devices 310 and 320 will be discussed later.

The first nonvolatile memory 120 is a nonvolatile memory such as a flash memory, for example, and stores the usage history list of the printing material containers. The usage history list includes identification information IDA1 to IDAn (where n is a natural number) of the printing material containers that have been mounted in the printing apparatus 100 and usage information UA1 to UAn (first usage information) corresponding to the identification information. When new identification information and usage information are written, the old information is not overwritten, and the new information is written to the address following the address that was written last time. The usage information will be discussed in detail later.

The reason for storing the usage history list in a flash memory rather than an EEPROM is because a flash memory is cheaper. The usage history list may, however, be stored in a different type of nonvolatile memory from a flash memory.

The second nonvolatile memory 130 is a nonvolatile memory such as an EEPROM, for example, and stores identification information IDB of the printing material containers that were mounted in the printing apparatus 100 and ink consumption information WB of each color when the printing apparatus 100 was last powered off or before a printing material container was replaced. Also, the second nonvolatile memory 130 may further store the write start address of the usage history list.

FIGS. 2A to 2D illustrate usage information in first to fourth exemplary configurations of the printing apparatus 100 of the present embodiment. Identification information of the printing material containers that have been mounted in the printing apparatus 100 and usage information corresponding to the identification information is written to the usage history list that is stored in the first nonvolatile memory 120. This usage information is specified by the printing apparatus controller 110 based on the ink consumption information of each color of the printing material containers. Note that, hereinafter, a three color integrated printing material container of the colors cyan (C), magenta (M) and yellow (Y) will be described as an example.

In the first exemplary configuration, the ink consumption information of the color having the largest ink consumption, among the ink consumption information of each color of the printing material container, is used as usage information. As shown in FIG. 2A, for example, in the case of (1), that is, in the case where the ink consumptions of C, M and Y are 30%, 20% and 15%, the consumption 30% of C, which is the largest ink consumption, is used as usage information. Also, in the case of (2), that is, in the case where the ink consumptions of C, M and Y are 5%, 15% and 10%, the consumption 15% of M, which is the largest ink consumption, is used as usage information. Also, in the case of (3), that is, in the case where the ink consumptions of C, M and Y are 60%, 50% and 70%, the consumption 70% of Y, which is the largest ink consumption, is used as usage information.

In the second exemplary configuration, the ink consumption information of the color having the smallest ink consumption, among the ink consumption information of each color of the printing material container, is used as usage information. As shown in FIG. 2B, for example, in the case of (1), the consumption 15% of Y, which is the smallest ink consumption, is used as usage information. Also, in the case of (2), the consumption 5% of C, which is the smallest ink consumption, is used as usage information. Also, in the case of (3), the consumption 50% of M, which is the smallest ink consumption, is used as usage information.

In the third exemplary configuration, the total ink consumption of the ink consumptions of the colors of the printing material container is used as usage information. As shown in FIG. 2C, for example, in the case of (1), the total ink consumption 65% is used as usage information. Also, in the case of (2), the total ink consumption 30% is used as usage information. Also, in the case of (3), the total ink consumption 180% is used as usage information.

In the fourth exemplary configuration, color information of the color having the largest ink consumption, among the ink consumption information of each color of the printing material container, and the ink consumption information thereof is used as usage information. As shown in FIG. 2D, for example, in the case of (1), the color information of C having the largest ink consumption and the consumption 30% is used as usage information. Also, in the case of (2), the color information of M having the largest ink consumption and the consumption 15% are used as usage information. Also, in the case of (3), the color information of Y having the largest ink consumption and the consumption 70% are used as usage information.

Thus, according to the printing apparatus 100 of the present embodiment, rather than the ink consumption of each color being written to the usage history list, only the ink consumption information of the color having the largest ink consumption, for example, can be written as usage information. Because this enables the amount of information that is written to be minimized, the storage capacity of the flash memory (first nonvolatile memory) can be reduced.

As will be discussed later, the printing apparatus controller 110, in the case where the relation between the usage information on the printing material container side and the usage information (first usage information) written to the usage history list does not satisfy a preset relation, executes error processing of the storage device of the printing material container. The usage information on the printing material container side that is compared with the usage information of the usage history list at this time is specified based on the ink consumption information of each color read from the storage device of the printing material container, as FIGS. 2A to 2D showed.

Furthermore, the printing apparatus controller 110 compares the usage information on the printing material container side with the usage information (second usage information) that is based on the ink consumption information of each color stored in the second nonvolatile memory, and performs error processing of the storage device of the printing material container. This usage information is also specified based on the ink consumption information of each color read from the second nonvolatile memory, as shown in FIGS. 2A to 2D.

Figure 3:
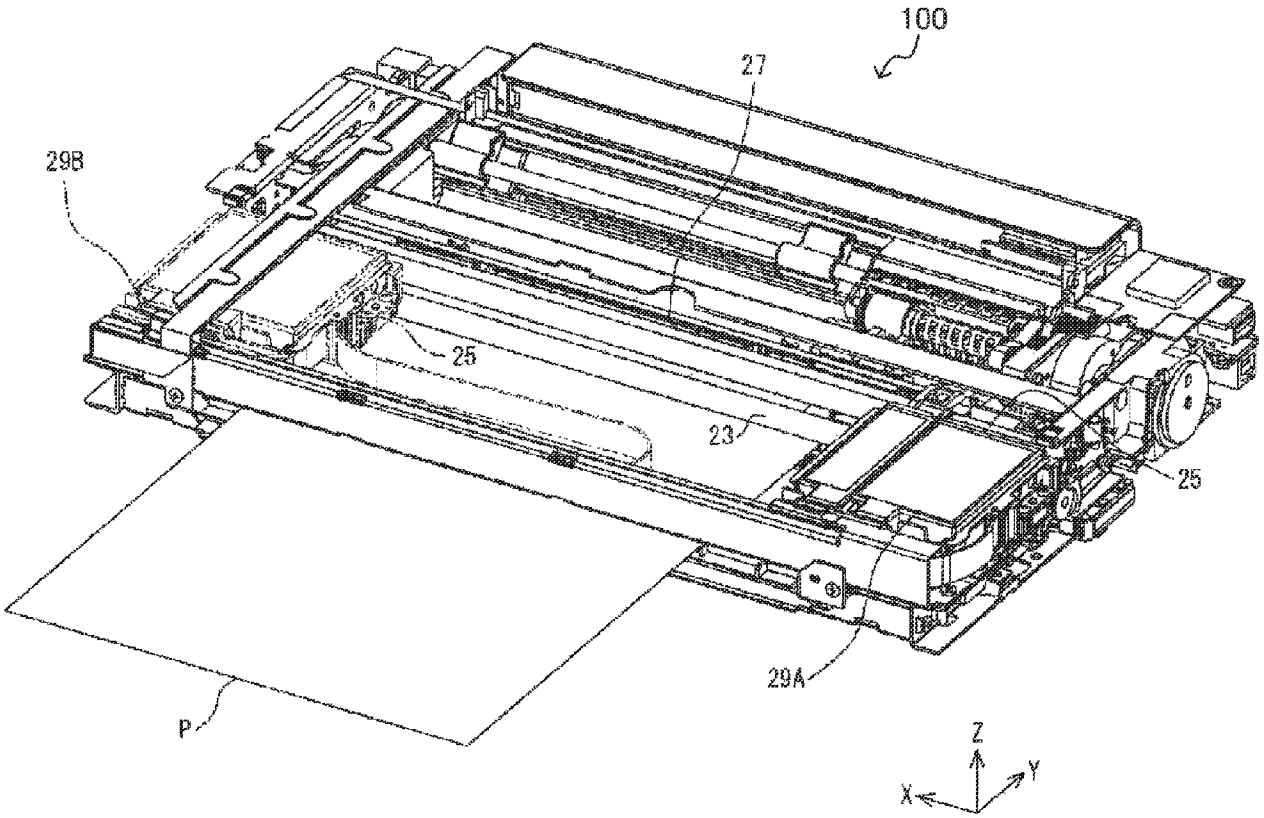
FIG. 3 shows an exemplary specific configuration of the printing apparatus.

FIG. 3 shows a specific exemplary configuration of the printing apparatus 100 of the present embodiment. The printing apparatus 100 has a conveyance roller 23 and a carriage 25. Also, the printing apparatus 100 has a medium conveyance mechanism (not shown) and a carriage conveyance mechanism (not shown). The medium conveyance mechanism conveys a recording medium P in a Y-axis direction by driving the conveyance roller 23 using power from a motor (not shown). The carriage conveyance mechanism conveys the carriage 25 in an X-axis direction by transmitting power from the motor (not shown) to the carriage 25 via a timing belt 27.

The carriage 25 is able to move reciprocally between a first standby position 29A and a second standby position 29B in the X-axis direction using the carriage conveyance mechanism. In the present embodiment, the movable region of the carriage 25 is between the first standby position 29A and the second standby position 29B.

Figure 4:
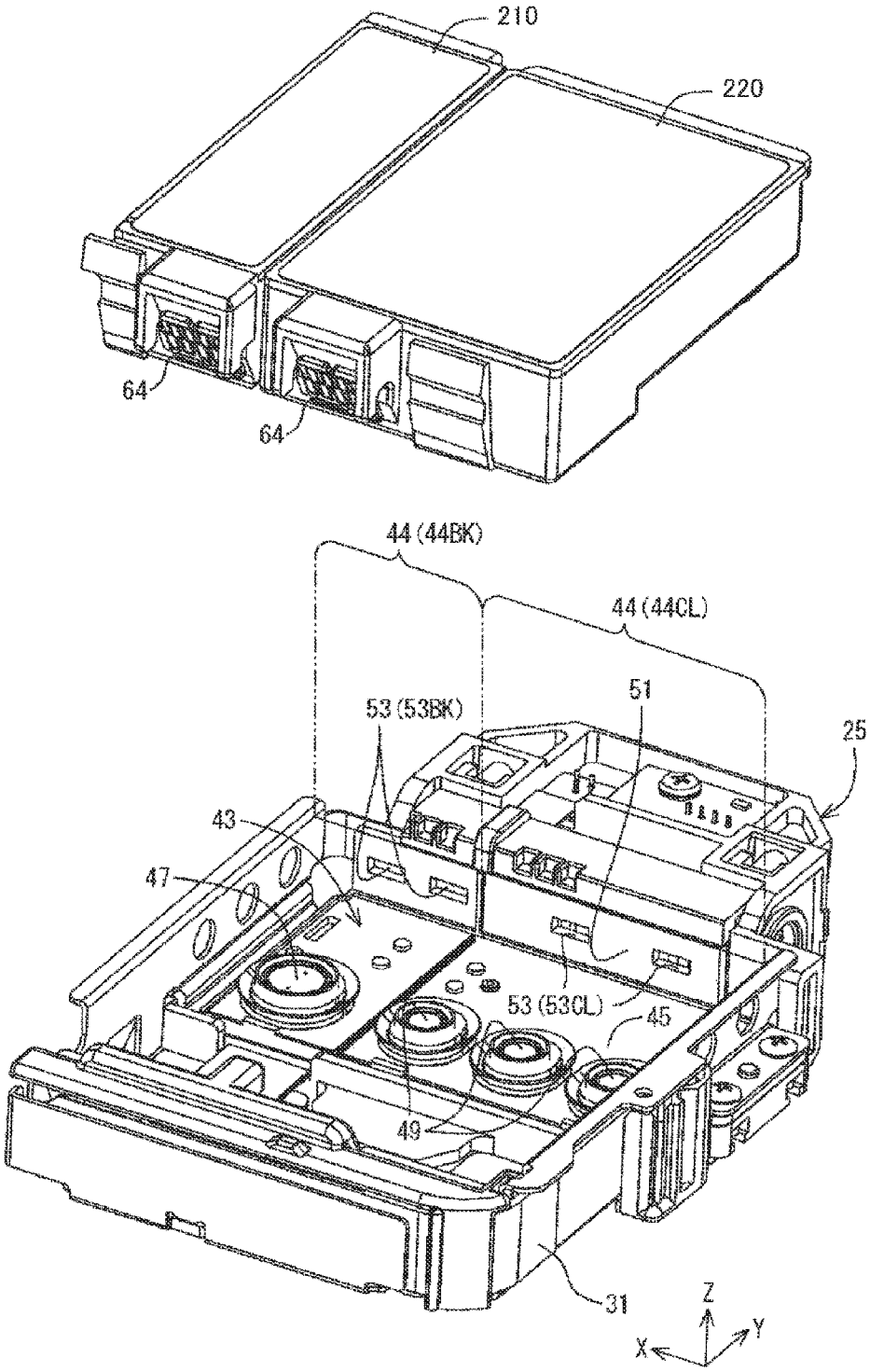
FIG. 4 shows an exemplary detailed configuration of a carriage and printing material containers.
Figure 5:
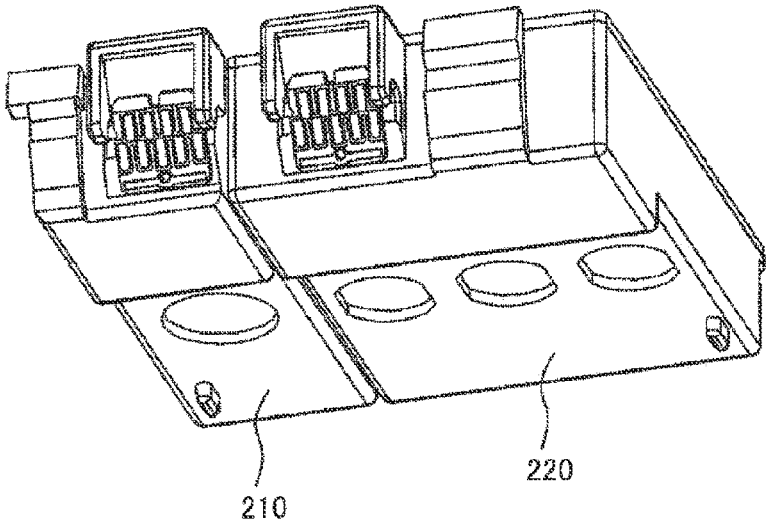
FIG. 5 shows an exemplary detailed configuration of a carriage and printing material containers.
Figure 5:
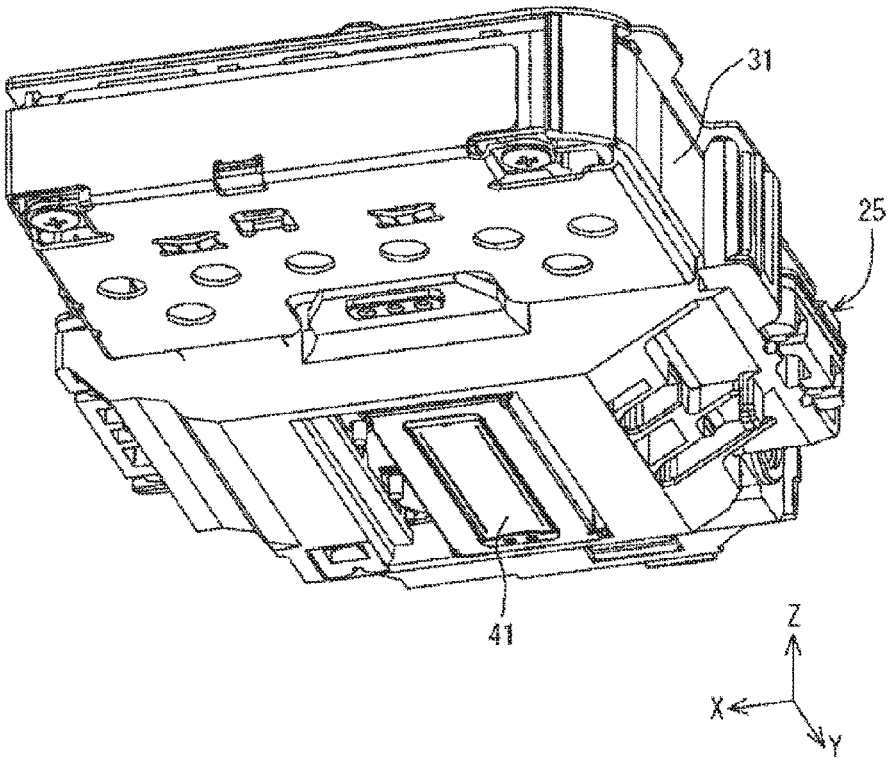
Figure 6:
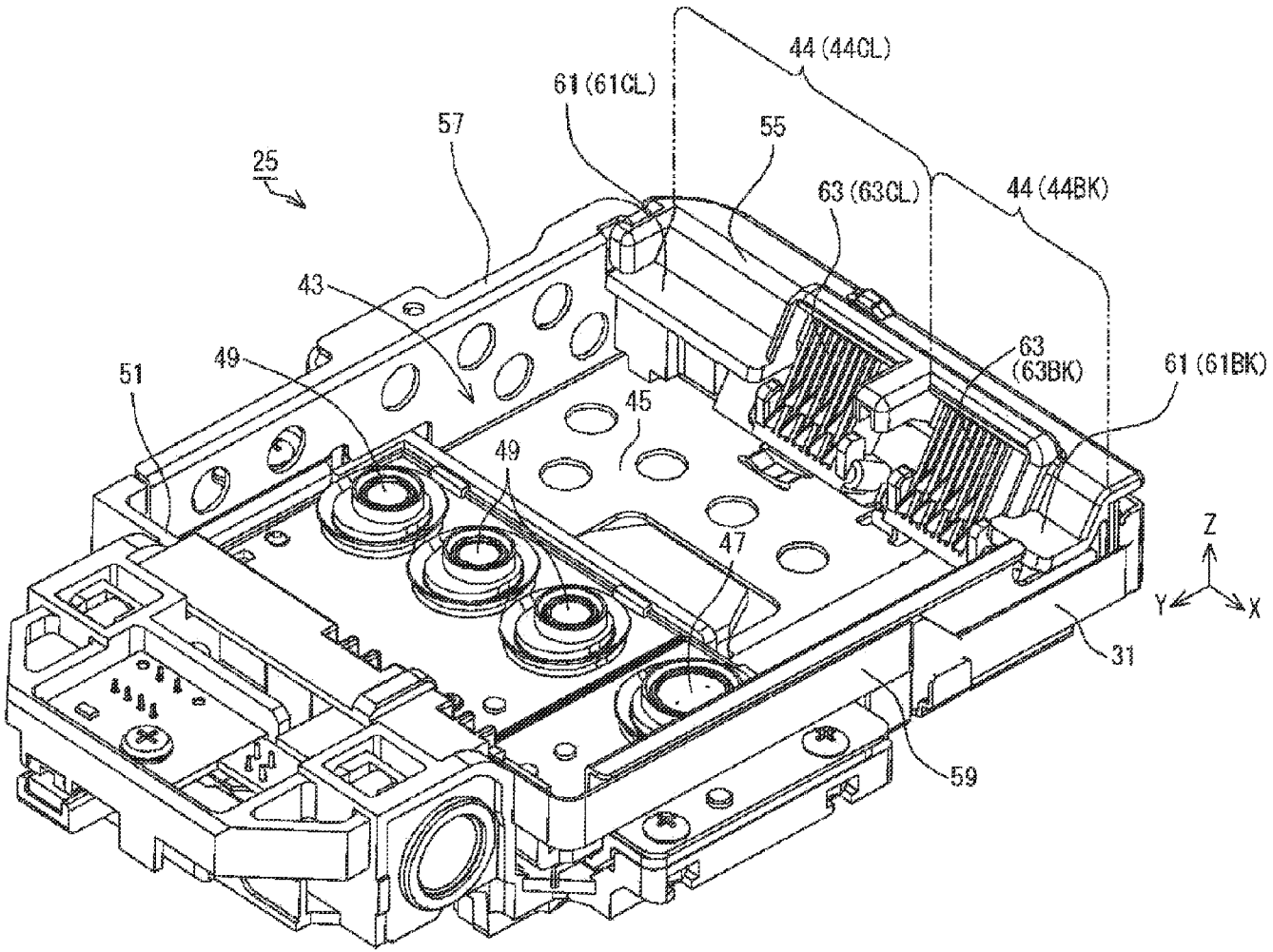
FIG. 6 shows an exemplary detailed configuration of a carriage.

FIG. 4 and FIG. 5 show an exemplary detailed configuration of the carriage 25 and the printing material containers 210 and 220. Also, FIG. 6 shows an exemplary detailed configuration of the carriage 25.

The carriage 25 has a holder 31. The printing material containers 210 and 220 are mounted in the holder 31. The printing material containers 210 and 220 are configured so as to be detachably mounted to the holder 31. The black ink is held in the printing material container 210. The printing material container 220 is a three-color integrated printing material container, and houses three types of ink, namely, yellow, magenta and cyan.

In the holder 31, a print head 41 is provided on the opposite side to the side of the printing material containers 210 and 220 in a Z-axis direction. In other words, the print head 41 is mounted in the carriage 25. Ink is supplied to the print head 41 from the printing material containers 210 and 220. The print head 41 discharges ink supplied from the printing material containers 210 and 220 as ink droplets from a nozzle (not shown).

As described above, the print head 41 is mounted in the carriage 25. The print head 41 can thus be conveyed in the X-axis direction via the carriage 25, using the carriage conveyance mechanism. Printing is performed on the recording medium P by discharging ink droplets from the print head 41, while changing the relative position of the print head 41 relative to the recording medium P, using the medium conveyance mechanism and the carriage conveyance mechanism.

Note that, with the printing apparatus 100, the direction in which the print head 41 is conveyed via the carriage 25 is defined as the X-axis direction, and the direction in which the recording medium P is conveyed is defined as the Y-axis direction. The direction that is orthogonal to both the X-axis direction and the Y-axis direction is the Z-axis direction. When the printing apparatus 100 is in use, the X-axis direction and the Y-axis direction are both the horizontal direction and the Z-axis direction is the vertical direction. However, in the following description, the Z-axis direction is sometimes described as a direction that is different from (intersects) the vertical direction. Note that the invention of the present embodiment can be applied, even if the orientation in which the carriage 25 is disposed changes 90 degrees.

The holder 31, as shown in FIG. 4, has a recessed part 43. The printing material containers 210 and 220 are mounted in the recessed part 43 of the holder 31.

Within the recessed part 43, a mounting position 44 corresponding to each of the printing material container 210 and the printing material container 220 that are mounted within the recessed part 43 are prescribed. The two mounting positions 44 are aligned in the X-axis direction within the recessed part 43. In other words, the printing material container 210 and the printing material container 220 are mounted within the recessed part 43, in a state of being mutually aligned in the X-axis direction. Hereinafter, in the case of separately identifying the two mounting positions 44, the mounting position 44 corresponding to the printing material container 210 will be denoted as a mounting position 44BK. Similarly, the mounting position 44 corresponding to the printing material container 220 will be denoted as a mounting position 44CL.

Within the recessed part 43, an inlet part 47 and three inlet parts 49 are provided on a bottom part 45 of the holder 31. The inlet part 47 is provided in the mounting position 44BK. Also, the three inlet parts 49 are provided in the mounting position 44CL. The inlet part 47 thus corresponds to the printing material container 210. Similarly, the three inlet parts 49 correspond to the printing material container 220. The inlet part 47 and the three inlet parts 49 are aligned in the X-axis direction.

Also, in the holder 31, a plurality of engaging holes 53 are provided in a side wall 51. In the present embodiment, two engaging holes 53 are provided per mounting position 44. In the present embodiment, four engaging holes 53 are thus provided in the holder 31. The four engaging holes 53 are aligned in the X-axis direction. Hereinafter, in the case of separately identifying the four engaging holes 53 in the respective mounting positions 44, the engaging holes 53 corresponding to the mounting position 44BK will be denoted as engaging holes 53BK, and the engaging hole 53 corresponding to the mounting position 44CL will be denoted as engaging holes 53CL.

The holder 31, as shown in FIG. 6, has a side wall 55 on the opposite side (negative Y-axis direction) to the side wall 51 across the inlet part 47 and the inlet parts 49 in the Y-axis direction. Also, a side wall 57 and a side wall 59 are provided in respective positions facing each other in the X-axis direction across the inlet part 47 and the inlet parts 49. The side wall 57 is located further in the negative X-axis direction than the inlet part 47 and the inlet parts 49. The side wall 59 is located further in the positive X-axis direction than the inlet part 47 and the inlet parts 49. The side wall 51, the side wall 55, the side wall 57 and the side wall 59 respectively project in positive Z-axis direction from the bottom part 45. The bottom part 45 is surrounded by the side wall 51, the side wall 55, the side wall 57 and the side wall 59. The recessed part 43 is thereby partitioned off.

An engagement part 61 is provided on the side wall 55 every mounting position 44. Two engagement parts 61 are respectively provided on the side of the side wall 55 facing the inlet part 47 and inlet parts 49 (positive Y-axis direction). The two engagement parts 61 respectively project from the side wall 55 toward the inlet part 47 and inlet parts 49. Hereinafter, in the case of separately identifying the two engagement parts 61, the engagement part 61 corresponding to the mounting position 44BK will be denoted as an engagement part 61BK, and the engagement part corresponding to the mounting position 44CL will be denoted as an engagement part 61CL.

Also, two contact mechanisms 63 are provided on the side wall 55 between the two engagement parts 61. One of the two contact mechanisms 63 is provided in the mounting position 44BK. Also, the other of the two contact mechanisms 63 is provided in the mounting position 44CL. Hereinafter, in the case of separately identifying the two contact mechanisms 63 in the respective mounting positions 44, the contact mechanism 63 corresponding to the mounting position 44BK will be denoted as a contact mechanism 63BK, and the contact mechanism 63 corresponding to the mounting position 44CL will be denoted as a contact mechanism 63CL.

As shown in FIG. 4, circuit boards 64 are provided in the printing material containers 210 and 220. The storage devices 310 and 320 is provided in the circuit boards 64. The contact mechanisms 63 are configured so as to be electrically connectable to the storage devices 310 and 320 provided in the circuit boards 64 of the printing material containers 210 and 220. In a state where the printing material containers 210 and 220 are mounted in the holder 31, the storage devices 310 and 320 provided in the circuit board 64 of the printing material containers 210 and 220 are then electrically connected to the printing apparatus 100 via the contact mechanisms 63. Various information is thereby transmitted between the storage devices 310 and 320 provided in the circuit boards 64 of the printing material containers 210 and 220 and the printing apparatus controller 110 of the printing apparatus 100.

2 . Processing by Printing Apparatus Controller 2-(1) Main Flow

The printing apparatus controller 110 performs error processing of the storage devices 310 and 320 of the printing material containers 210 and 220 or processing for additionally writing identification information and second usage information to the first nonvolatile memory 120, before starting of a printing operation, when returning from power saving mode, or after replacing a printing material container.

Figure 7:
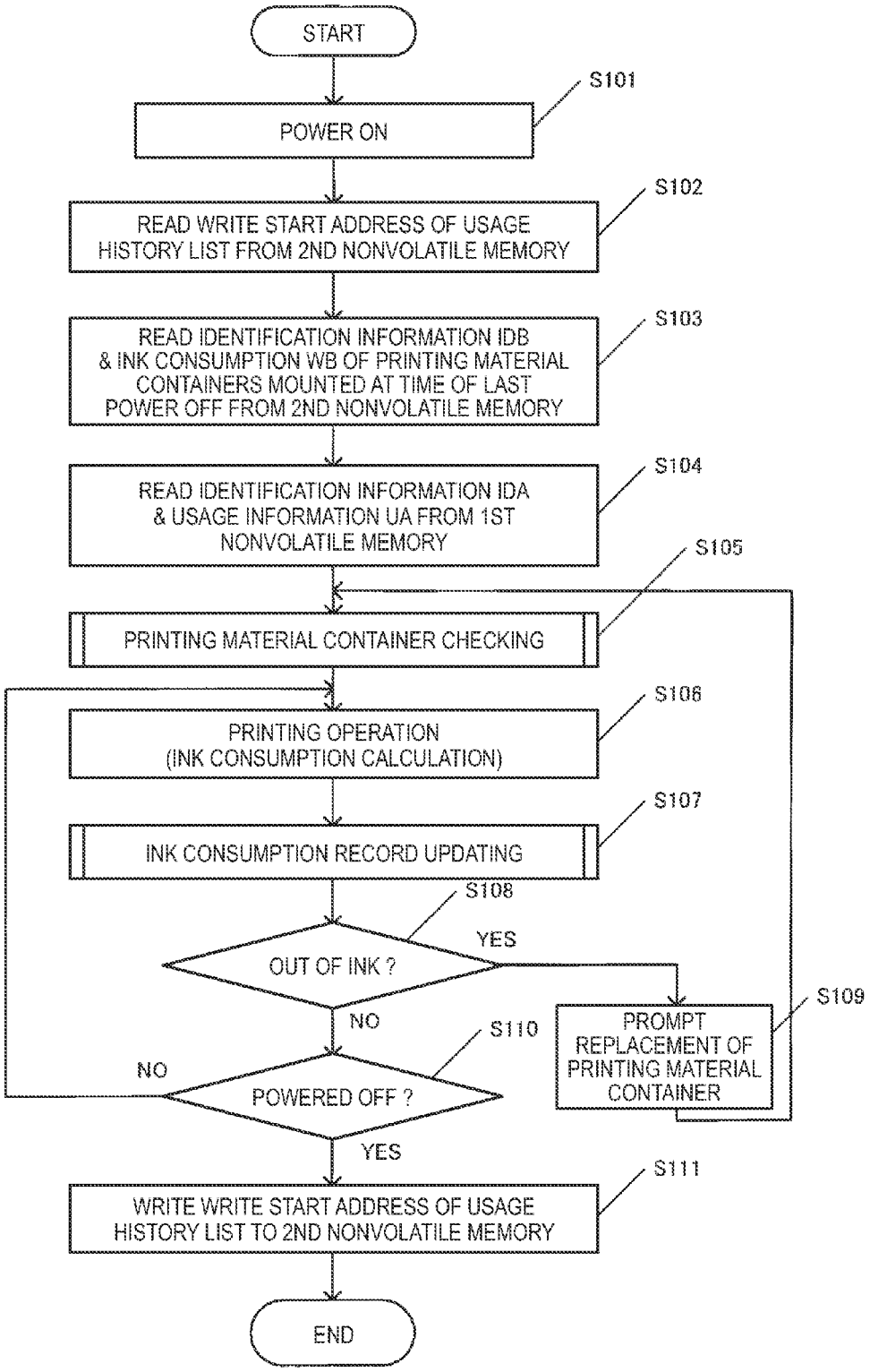
FIG. 7 shows an exemplary flowchart of update processing of a usage history list and error detection processing of a printing material container.

FIG. 7 shows an exemplary flowchart of usage history list update processing and error detection processing of the printing material containers in the printing apparatus 100 of the present embodiment. The flow shown in FIG. 7 is executed under the control of the printing apparatus controller 110. Powering on of the printing apparatus 100 in step S101, however, is carried out by the user.

Upon the printing apparatus 100 being powered on (step S101), the printing apparatus controller 110 reads the write start address of the usage history list from the second nonvolatile memory. When the printing apparatus controller 110 performs additional writing of identification information and usage information to the usage history list stored in the first nonvolatile memory 120, the information is written from this write start address.

Next, the printing apparatus controller 110 reads the identification information IDB and the ink consumption information WB on the printing material containers that were mounted in the printing apparatus 100 when the printing apparatus 100 was last powered off from the second nonvolatile memory 130 (step S103). The printing apparatus controller 110 then reads the identification information IDA1 to IDAn, and the corresponding usage information UA1 to UAn in the usage history list from the first nonvolatile memory 120 (step S104). The read identification information IDB, ink consumption information WB, identification information IDA1 to IDAn, and usage information UA1 to UAn is expanded in RAM provided in the printing apparatus controller 110.

Next, the printing apparatus controller 110 executes printing material container check processing (step S105). The flow of printing material container check processing will be discussed later.

Next, the printing apparatus controller 110 performs a printing operation, and counts the ink consumption of each ink color (step S106). Update processing of ink consumption records is then executed (step S107). The flow of update processing of ink consumption records will be discussed later.

Next, the printing apparatus controller 110 determines whether there is a printing material container that has run out of ink (step S108). Specifically, the printing apparatus controller 110 determines whether ink end information is written in the storage devices 310 and 320 of the printing material containers 210 and 220. If there is a printing material container that has run out of ink, the printing apparatus controller 110 performs processing for displaying a message or the like prompting the user to replace the printing material container (step S109). Steps S105 to S107 are then repeated.

On the other hand, if there is not a printing material container that has run out of ink, the processing advances to step S110, and if the printing apparatus controller 110 does not detect powering off of the printing apparatus 100, steps S106 to S108 are repeated.

If the printing apparatus controller 110 detects powering of the printing apparatus 100, the printing apparatus controller 110 writes the write start address of the usage history list to the second nonvolatile memory (step S111).

2-(2) Printing Material Container Check Processing

Figure 8:
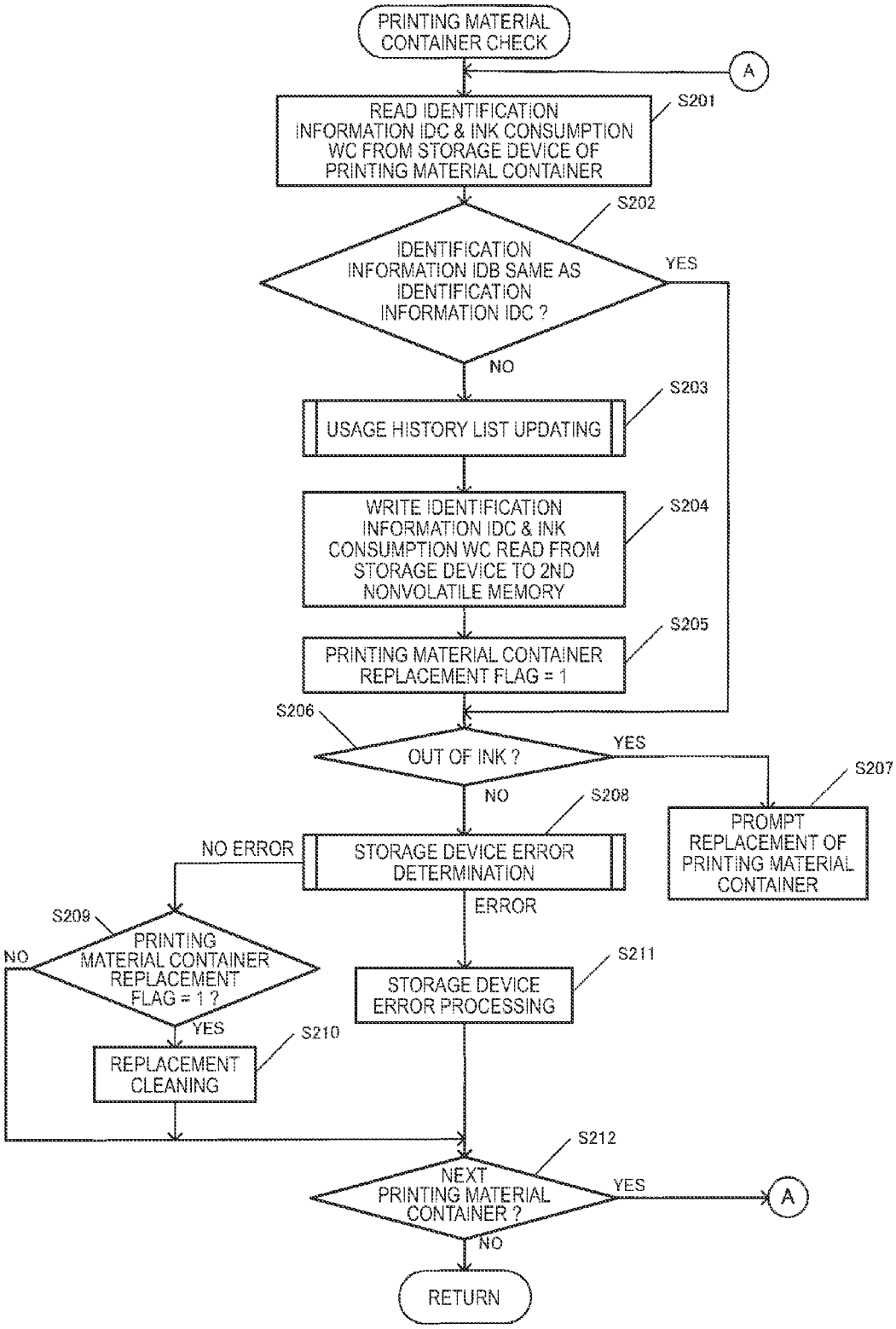
FIG. 8 shows an exemplary detailed flowchart of printing material container check processing.

FIG. 8 shows an exemplary detailed flowchart of printing material container check processing (step S105 of FIG. 7).

Initially, the printing apparatus controller 110 reads the identification information IDC and the ink consumption information WC from the storage device 310 (or 320) of the printing material container 210 (or 220) that is currently mounted (step S201).

Next, the printing apparatus controller 110 compares the identification information IDB read from the second nonvolatile memory 130 at step S103 of FIG. 7 with identification information IDC read from the storage device 310 (320), and determines whether both are the same (step S202).

If the identification information IDB and the identification information IDC are not the same, that is, if the printing material container has been exchanged, the printing apparatus controller 110 performs usage history list update processing (step S203). The identification information and usage information of the printing material containers that were mounted before the replacement are additionally written to the usage history list in this usage history list update processing. A detailed flow of the usage history list update processing will be discussed later.

Next, the printing apparatus controller 110 writes the identification information IDC and the ink consumption information WC read from the storage device 310 (320) to the second nonvolatile memory 130. That is, the second identification information IDB and the ink consumption information WB in the nonvolatile memory 130 are updated with the identification information IDC and the ink consumption information WC in the storage device 310 (320) of the printing material container 210 (220) (step S204). A printing material container replacement flag is then set to 1 (step S205).

On the other hand, in the case where the identification information IDB and the identification information IDC are the same, the printing apparatus controller 110 advances to step S206 without performing usage history list update processing.

Next, the printing apparatus controller 110 determines whether ink end information are written to the storage device 310 (320) of the printing material container 210 (220) (step S206). If ink end information is written in the storage device 310 (320), the printing apparatus controller 110 performs processing for displaying a message and the like prompting the user to replace the printing material container (step S207).

On the other hand, if ink end information is not written in the storage device 310 (320), the printing apparatus controller 110 performs storage device error determination processing (step S208). The detailed flow of error determination processing will be discussed later. If it is determined by the error determination processing that there is an error, the printing apparatus controller 110 performs error processing of the storage device (step S211). This error processing includes processing such as the following, for example.

(1) Read the ink consumption information WC from the storage device 310 (320) again.
(2) Write the ink consumption information that is based on the usage information read from the usage history list to the storage device 310 (320).
(3) Display a message or the like prompting the user to replace or remount the printing material container 210 (220).

The printing apparatus controller 110 judges, after the end of error processing, whether there is a printing material container to be checked next (step S212), and, if there is a following printing material container, returns to step S201 and performs the processing on the following printing material container.

On the other hand, if it is determined by error determination processing that there is not an error, the printing apparatus controller 110 determines whether the printing material container replacement flag is set to 1 (step S210) and, if set to 1 , performs replacement cleaning processing (processing for filling the ink path from the printing material container to the print head with ink) (step S210).

After the end of replacement cleaning, it is judged whether there is a printing material container to be checked next (step S212) and if there is a following printing material container, the processing returns to step S201, and processing is performed on the following printing material container.

2-(3) Use History List Update Processing

The printing apparatus controller 110, in the case where the identification information stored in the second nonvolatile memory 130 and the identification information read from the storage devices 310 and 320 of the printing material containers 210 and 220 that are currently mounted do not match, and the second usage information that is based on the ink consumption information of each color stored in the second nonvolatile memory 130 satisfies a predetermined condition, performs processing for additionally writing the identification information stored in the second nonvolatile memory 130 and the second usage information that is based on the ink consumption information of each color stored in the second nonvolatile memory 130 to the first nonvolatile memory 120.

Also, the printing apparatus controller 110, in the case where identification information that is the same as the identification information stored in the second nonvolatile memory 130 is already stored in the first nonvolatile memory 120, compares the second usage information with the first usage information associated with the same identification information that is already stored in the first nonvolatile memory 120, and judges, based on a comparison result, whether to perform additional writing of the identification information and the second usage information stored in the second nonvolatile memory 130 to the first nonvolatile memory 120.

Figure 9:
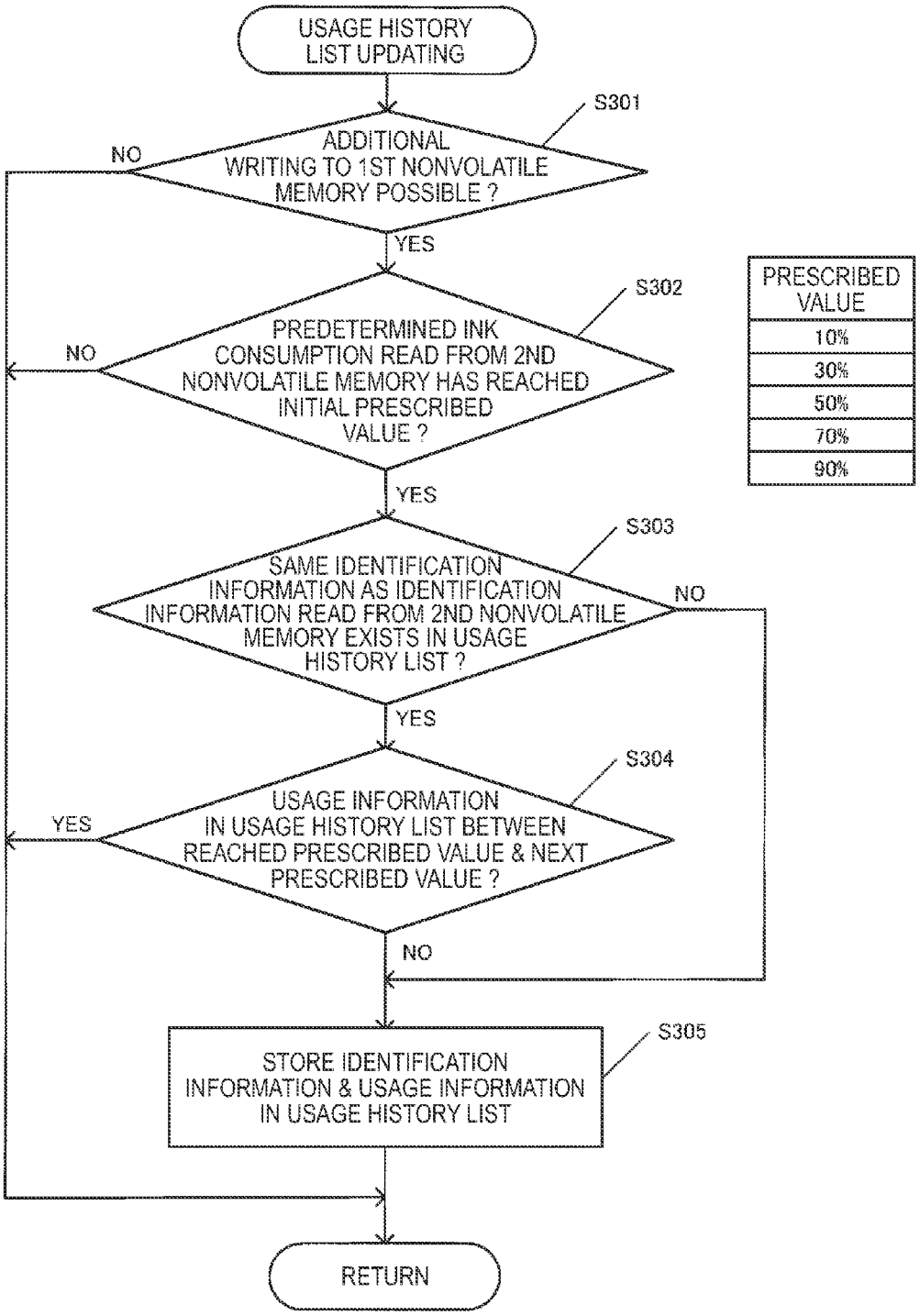
FIG. 9 shows an exemplary detailed flowchart of usage history list update processing.

FIG. 9 shows an exemplary detailed flowchart of the usage history list update processing (step S203 of FIG. 8). As is clear from the flowchart of FIG. 8, usage history list update processing is executed in the case where a printing material container has been replaced.

Initially, the printing apparatus controller 110 judges whether additional writing of identification information and usage information to the usage history list of the first nonvolatile memory 120 is possible (step S301). If additional writing is possible, the processing advances to the following step S302, but if additional writing is not possible, usage history list update processing is not executed. In a normal usage configuration (usage configuration in which a printing material container is used in one printing apparatus, and is continuously used from when the printing material container is first used until the printing material runs out), additional writing to the usage history list is performed once per printing material container, and, accordingly, it is very unlikely that the storage capacity of the first nonvolatile memory 120 (flash memory) would be insufficient.

Next, the printing apparatus controller 110 judges whether a predetermined ink consumption read from the second nonvolatile memory 130 has reached an initial prescribed value which is the smallest value among a plurality of prescribed values (step S302). The identification information and ink consumption information of the printing material containers that were mounted before replacement are stored in the second nonvolatile memory 130. Accordingly, it is judged whether the predetermined ink consumption of the printing material containers that were mounted before replacement has reached the initial prescribed value which is the smallest value of a plurality of prescribed values.

Here, "predetermined ink consumption" is ink consumption information that is used as the usage information described with FIGS. 2A to 2D. Hereinafter, the case of the usage information shown in FIG. 2A (the case of the first exemplary configuration) will be described, but the same applies to the cases shown in FIGS. 2B, 2C and 2D. The "plurality of prescribed values" are a plurality of prescribed values of ink consumption set in advance, such as 10%, 30%, 50%, 70% and 90%, for example. In this case, the " initial prescribed value" is 10%.

If the predetermined ink consumption does not exceed the initial prescribed value (if the judgment of step S302 is NO), the processing is ended since the usage history list will not be updated.

In the case where the predetermined ink consumption has reached the next prescribed value among the plurality of prescribed values, the printing apparatus controller 110 judges whether identification information that is the same as the identification information IDB read from the second nonvolatile memory 130 exists in the usage history list (step S303). In the case where identification information that is the same as the identification information IDB does not exist in the usage history list, processing for additionally writing the identification information and the usage information (predetermined ink consumption information) to the usage history list is performed (step S305).

On the other hand, if identification information that is the same as the identification information IDB does exist in the usage history list, the printing apparatus controller 110 judges whether the usage information corresponding to the identification information in the usage history list is between the prescribed value that was reached and the next prescribed value (step S304). For example, in the case where the predetermined ink consumption read from the second nonvolatile memory is 35%, the prescribed value that was reached is 30% and the next prescribed value is 50%. If the usage information corresponding to the identification information in the usage history list is between 30% and 50%, the usage history list is not updated. On the other hand, if the usage information corresponding to the identification information in the usage history list is not between 30% and 50%, processing for additionally writing the identification information and the usage information to the usage history list is performed (step S305). Thereafter, the processing returns to step S204 of FIG. 8.

With the printing apparatus 100 of the present embodiment, in the case where a printing material container is replaced, additional writing of the identification information and usage information of the printing material containers that were mounted before replacement to the usage history list can thus be performed. In this way, even in the case where a printing material container that was removed is mounted again, it can be determined that the printing material container is not a new printing material container.

Furthermore, with the printing apparatus 100 of the present embodiment, in the case where the predetermined ink consumption of the printing material container before replacement has reached the next prescribed value among a plurality of prescribed values, and, moreover, the same identification information is not stored in the usage history list, or the same identification information is stored in the usage history list but the usage information corresponding thereto is not between the prescribed value that the predetermined ink consumption of the printing material container before replacement has reached and the next prescribed value, additional writing of the identification information and the usage information to the usage history list is performed. In this way, the number of times writing is performed to the first nonvolatile memory 120 (flash memory) can be restricted to smallest number possible.

2-(4) Error Determination Processing

The printing apparatus controller 110 compares the usage information on the printing material container side that is based on the ink consumption information of each color read from the storage devices 310 and 320 of the printing material containers 210 and 220 mounted in the printing apparatus 100 with the first usage information associated with the identification information that is the same as the identification information of the printing material containers 210 and 220 mounted in the printing apparatus 100. If the relation between the usage information on the printing material container side and the first usage information does not satisfy a preset relation, error processing of the storage devices 310 and 320 of the printing material containers 210 and 220 is executed.

Specifically, the printing apparatus controller 110, in the case where the ink consumption that is based on the usage information on the printing material container side is less than the ink consumption that is based on the first usage information, performs error processing of the storage devices 310 and 320, having judged that the relation between the usage information on the printing material container side and the first usage information does not satisfy the preset relation. Also, the printing apparatus controller 110 compares the usage information on the printing material container side with the second usage information that is based on the ink consumption information of each color stored in the second nonvolatile memory, and, in the case where the ink consumption that is based on the usage information on the printing material container side is less than the ink consumption that is based on the second usage information, executes error processing of the storage devices 310 and 320.

Figure 10:
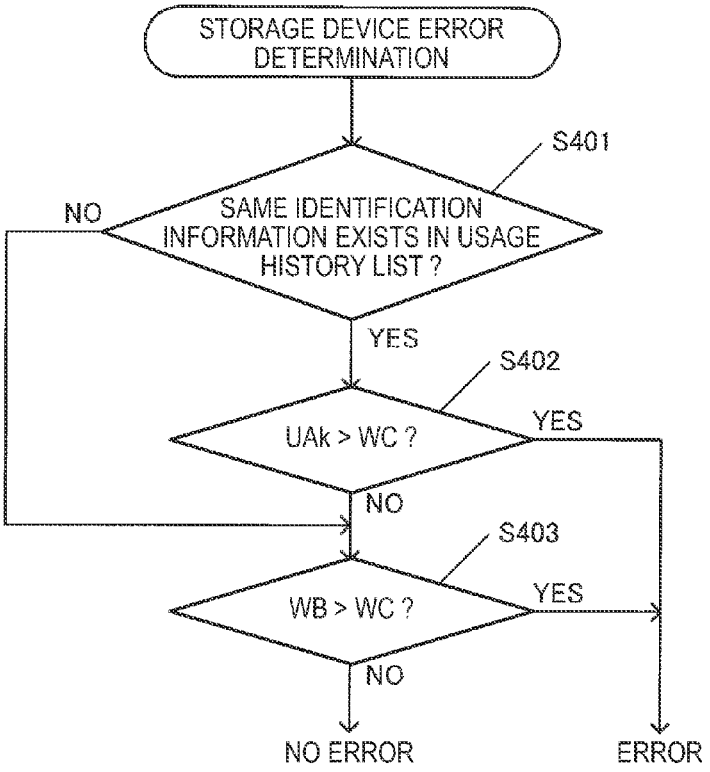
FIG. 10 shows an exemplary detailed flowchart of storage device error determination processing.

FIG. 10 shows an exemplary detailed flowchart of storage device error determination processing (step S208 of FIG. 8).

The printing apparatus controller 110 judges whether identification information that is the same as the identification information read from the second nonvolatile memory exists in the usage history list (step S401). In the case where the same identification information exists in the usage history list, it is judged whether a predetermined ink consumption WC of the printing material containers that are currently mounted (usage information on the printing material container side) is smaller than the usage information UAk (first usage information) corresponding to the identification information IDAk on the usage history list (k is an integer where $1 \leq k \leq n$) (step S402).

If, in step S401, plural pieces of identification information that are the same as the identification information read from the second nonvolatile memory 130 exist in the usage history list, the usage information UAk corresponding to the most recently updated identification information IDAk is compared with the predetermined ink consumption WC of the printing material containers. Also, in the abovementioned fourth exemplary configuration (for example, FIG. 2D), in the case where identification information that is the same as the identification information read from the second nonvolatile memory 130 exists in the usage history list, the most recently updated usage information UAk is compared with the ink consumption of the color corresponding to the color information of the most recently updated usage information UAk, among the ink consumptions of the printing material containers that are currently mounted.

If UAk>WC, the printing apparatus controller 110 determines that there is a storage device error. If not UAk>WC, the printing apparatus controller 110 further determines whether the predetermined ink consumption WC is less than the predetermined ink consumption WB (second usage information) read from the second nonvolatile memory (step S403). If WB>WC, the printing apparatus controller 110 determines that there is a storage device error. If not WB>WC, the printing apparatus controller 110 determines that there is not a storage device error.

In step S401, in the case where identification information that is the same does not exist in the usage history list, error determination is performed using step S403.

If the ink consumption information stored in the storage device is normal, UAk≤WC and WB≤WC. This is because it is not possible for the present ink consumption stored in the storage device of the printing material container to have decreased to less than the past ink consumption stored in the usage history list or the second nonvolatile memory 130. If there is such a decrease, possibly an error has occurred in the information in the storage device of the printing material container or a reading error has occurred at the time of reading out information from the storage device.

Thus, according to the printing apparatus 100 of the present embodiment, even in the case where a printing material container that has been removed is mounted again later, it can be determined that the printing material container is not a new printing material container, and it can be further determined whether the ink consumption information stored in the storage device of the printing material container is normal.

2-(5) Update Processing of Ink Consumption Record

Figure 11:
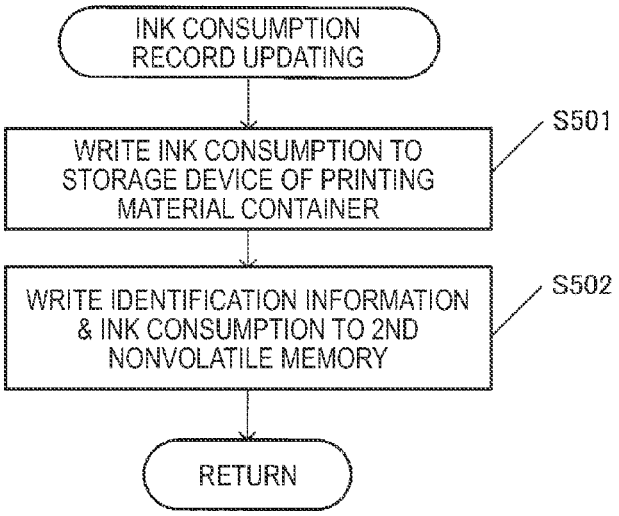
FIG. 11 shows an exemplary detailed flowchart of ink consumption record update processing.

FIG. 11 shows an exemplary detailed flowchart of update processing of an ink consumption record (step S107 of FIG. 7).

The printing apparatus controller 110 writes ink consumptions to the storage devices 310 and 320 of the printing material containers 210 and 220 (step S501). Specifically, the printing apparatus controller 110 counts the ink consumption of each ink color, and writes the ink consumption of each ink color to the storage devices 310 and 320 of the printing material containers 210 and 220 at predetermined time intervals, together with performing a printing operation. This writing is performed with greater frequency than the frequency at which the printing apparatus controller 110 writes identification information and usage information in the first nonvolatile memory 120. That is, the printing apparatus controller 110 performs the writing for updating the ink consumption information of each color to the storage devices 310 and 320 of the printing material containers 210 and 220, at a higher frequency than the frequency at which identification information and usage information is written to the first nonvolatile memory 120.

Next, the printing apparatus controller 110 writes the identification information and ink consumption information to the second nonvolatile memory 130 (step S502). In this way, the ink consumption of each color is correctly stored in the second nonvolatile memory 130 together with the increase in the ink consumption of each color associated with printing operations. As a result, the second nonvolatile memory 130 is able to store the identification information and the ink consumption information of each color of the printing material containers that were mounted in the printing apparatus 100 when the printing apparatus 100 was last powered off or before replacement of a printing material container.

2-(6) Exemplary Usage History List Update Processing

Figure 12A:
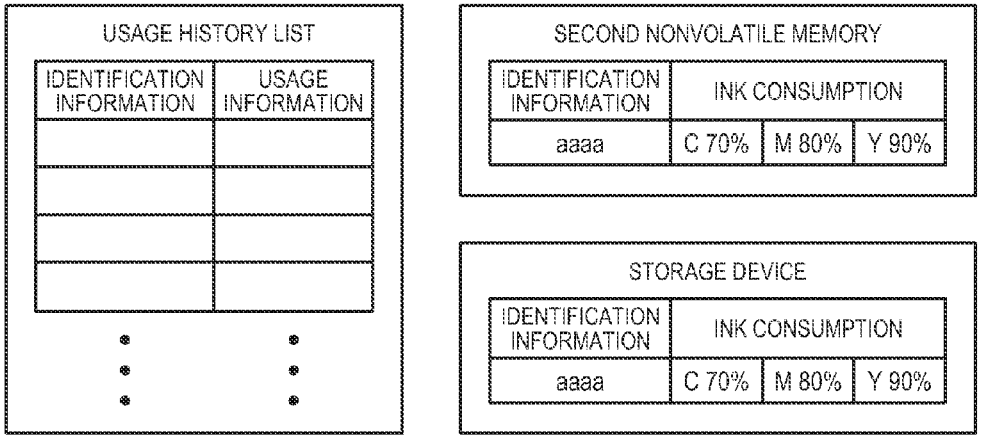
FIGS. 12A, 12B and 12C illustrate usage history list update processing in the case where a printing material container is replaced after starting use from an initial state.
Figure 12B:
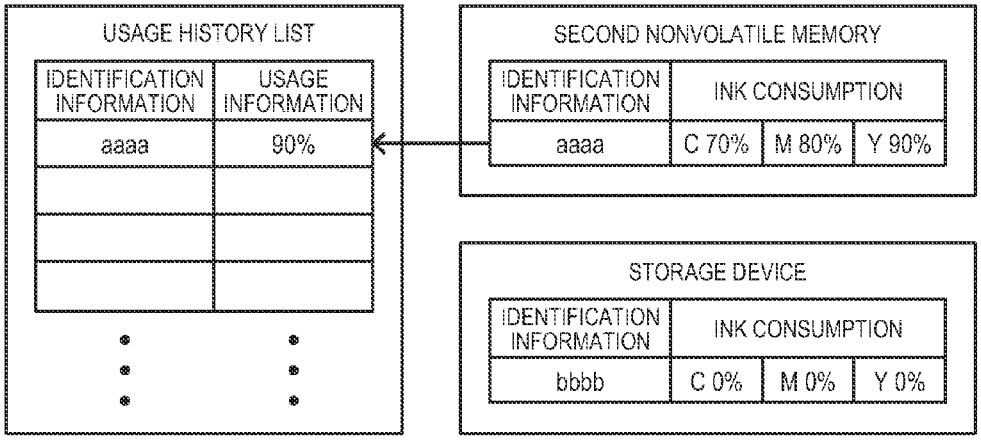
Figure 12C:
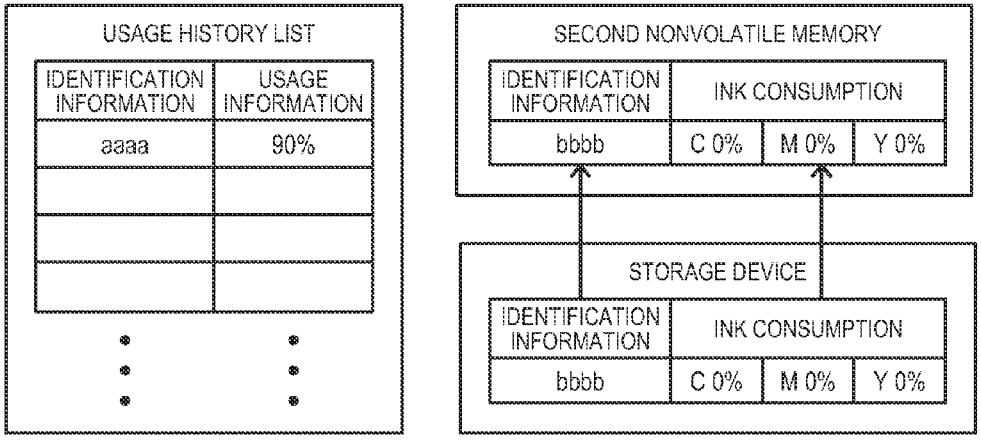

FIGS. 12A, 12B and 12C illustrate usage history list update processing in the case where a printing material container is replaced after starting use from an initial state in the printing apparatus 100 of the present embodiment. Note that although, in FIGS. 12A, 12B and 12C, the case of a three-color integrated printing material container 220 is shown, the same applied to the case of the monochrome type printing material container 210. Also, with regard to the usage information that is stored in the usage history list, the largest ink consumption among the ink consumptions of the three colors (C, M, Y) is taken as the usage information, as shown in FIG. 2A.

FIG. 12A shows a state where 70%, 80% and 90% are stored as the ink consumptions of C, M and Y in the second nonvolatile memory 130 and storage device 320, as a result of mounting a printing material container (identification information "aaaa") in an initial state and repeating print processing. Because a printing material container has not been replaced before, the usage history list is still an initial state with nothing stored.

FIG. 12B shows a state where a new printing material container (identification information "bbbb") is mounted. Because the identification information "aaaa" stored in the second nonvolatile memory 130 and the identification information "bbbb" stored in the storage device 320 are not the same, the printing apparatus controller 110 executes usage history list update processing (step S202 of FIG. 8). The highest value of the ink consumptions stored in the second nonvolatile memory 130 is 90%, and this value has reached the prescribed value 90% among the plurality of prescribed values (step S302 of FIG. 9). Furthermore, because identification information that is the same as the identification information "aaaa" stored in the second nonvolatile memory 130 does not exist in the usage history list (step S303 of FIG. 9), the printing apparatus controller 110 performs additional writing of the identification information "aaaa" and the usage information 90% to the usage history list (step S305 of FIG. 8).

As shown in FIG. 12C, the printing apparatus controller 110 writes the identification information "bbbb" and ink consumption (C, M, Y all 0%) read from the storage device 320 to the second nonvolatile memory 130, after updating of the usage history list (step S204 of FIG. 8).

Figure 13A:
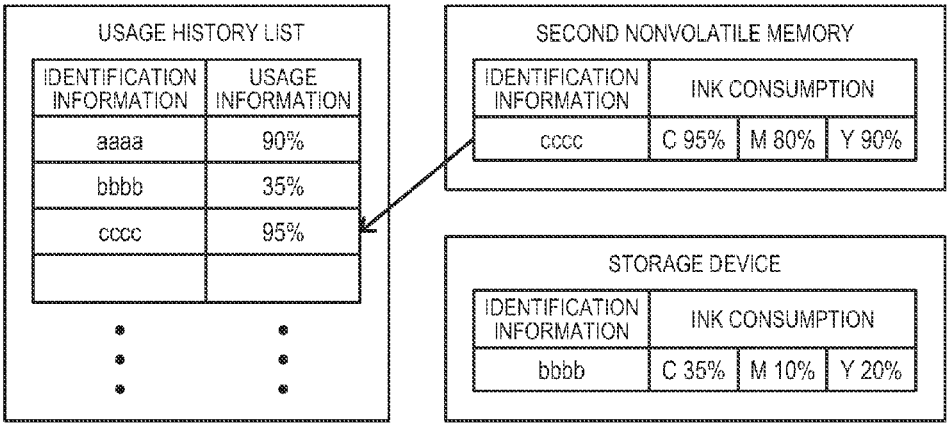
FIGS. 13A, 13B and 13C illustrate usage history list update processing in the case where a printing material container is remounted.
Figure 13B:
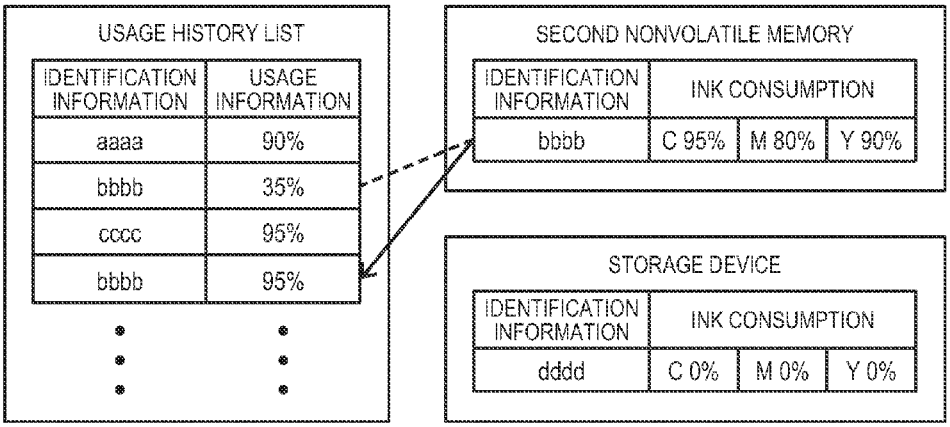
Figure 13C:
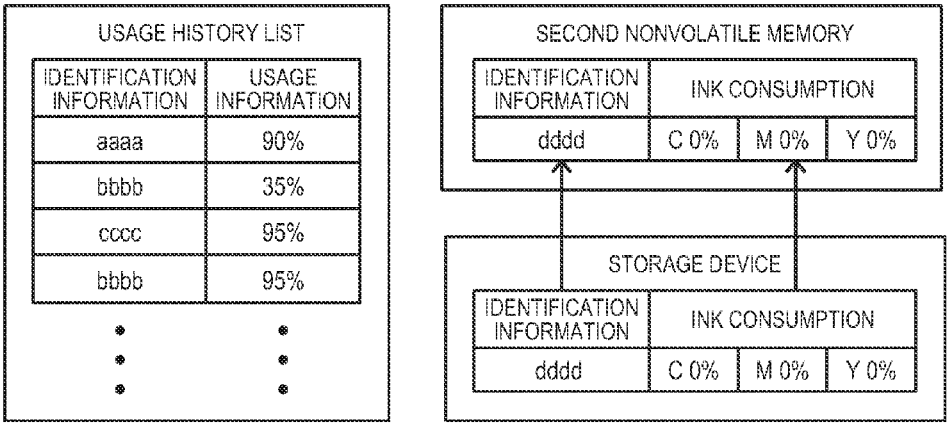

FIGS. 13A, 13B and 13C illustrate usage history list update processing in the printing apparatus 100 of the present embodiment, in the case where a printing material container is remounted. Similarly to the abovementioned FIGS. 12A, 12B and 12C, the case of the three-color integrated printing material container 220 is shown, and the largest ink consumption among the ink consumptions of the three colors (C, M, Y) is taken as the usage information.

FIG. 13A shows a state in which printing has been performed after mounting three printing material containers (identification information "aaaa", "bbbb" and "cccc") in order, and a printing material container (identification information "bbbb") has been remounted. Because the identification information "cccc" stored in the second nonvolatile memory 130 and the identification information "bbbb" stored in the storage device 320 are not the same, the printing apparatus controller 110 executes usage history list update processing (step S202 of FIG. 8). The highest value of the ink consumptions stored in the second nonvolatile memory 130 is 95%, and this value has reached the prescribed value 90% among the plurality of prescribed values (step S302 of FIG. 9). Furthermore, because identification information that is the same as the identification information "cccc" stored in the second nonvolatile memory 130 does not exist in the usage history list (step S303 of FIG. 9), the printing apparatus controller 110 performs additional writing of the identification information "cccc" and the usage information 95% to the usage history list (step S305 of FIG. 8).

In the state shown in FIG. 13A, because the highest value 35% of the ink consumptions stored in the storage device 320 is not smaller than the usage information 35% corresponding to the identification information "bbbb" stored in the usage history list, it is determined in the storage device error determination processing that an error has not occurred (step S402 of FIG. 10). However, in the case where the highest value of the ink consumptions stored in the storage device 320 decreases to less than 35%, it is determined that an error has occurred.

FIG. 13B shows the case where a new printing material container (identification information "dddd") is mounted, after printing using the remounted printing material container (identification information "bbbb"). Because the identification information "bbbb" stored in the second nonvolatile memory 130 and the identification information "dddd" stored in the storage device 320 are not the same, the printing apparatus controller 110 executes usage history list update processing (step S202 of FIG. 8). The highest value of the ink consumptions stored in the second nonvolatile memory 130 is 95%, and this value has reached the prescribed value 90% among the plurality of prescribed values (step S302 of FIG. 9). Furthermore, because identification information that is the same as the identification information "bbbb" stored in the second nonvolatile memory 130 exists in the usage history list (step S303 of FIG. 9), and the usage information 35% in the usage history list is smaller than the prescribed value 90% that was reached (step S304 of FIG. 9), the printing apparatus controller 110 performs additional writing of the identification information "bbbb" and the usage information 95% to the usage history list (step S305 of FIG. 8).

As shown in FIG. 13C, the printing apparatus controller 110 writes the identification information "dddd" and ink consumptions (C, M, Y all 0%) read from the storage device 320 after updating of the usage history list to the second nonvolatile memory 130 (step S204 of FIG. 8).

As described above, according to the printing apparatus 100 of the present embodiment, the printing material containers can be miniaturized because of being able to use a multi-color integrated printing material container, enabling a printing apparatus that is compact and portable to be realized as a result.

Also, additional writing of usage information that is based on the ink consumption of each color of the multi-color integrated printing material container to the usage history list that records information about printing material containers used in the past can be performed only in the case where a predetermined condition is satisfied. In this way, it becomes possible to reduce the storage capacity of the flash memory or the like for storing the usage history list, enabling costs to be reduced as a result.

Also, the ink consumption information stored in the storage device of the printing material container and the usage information stored in the usage history list are compared, and storage device error processing can be executed in the case where the relation between the information does not satisfy a preset relation. In this way, it is possible to enhance the reliability of print processing because of being able to reliably detect and deal with a storage device error.

Note that although the present embodiment has been described in detail above, a person skilled in the art will appreciate that numerous modifications can be made without departing in substance from the novel matter and effects of the invention. Accordingly, all such modifications are within the scope of the invention. For example, terms that appear in the description or drawings at least once together with other broader or synonymous terms can be replaced by those other terms at any place within the description or drawings. Also, the configurations, operations and the like of the printing apparatus are not limited to those described in the present embodiment, and various modifications can be made.

The entire disclosure of Japanese Patent Application No. 2013-179754 , filed on Aug. 30, 2013 is expressly incorporated herein by reference.

What is claimed is:

1. A printing apparatus capable of mounting a multi-color integrated printing material container having a storage device that stores identification information of the printing material container and ink consumption information of each color, the printing apparatus comprising:

a first nonvolatile memory that stores the identification information of printing material containers mounted one or more times in the printing apparatus, and first usage information that is based on the ink consumption information of each color of the printing material containers;

a second nonvolatile memory; and a printing apparatus controller that controls print processing, wherein the printing apparatus controller compares usage information on the printing material container side that is based on the ink consumption information of each color read from the storage device of a printing material container that is mounted in the printing apparatus with the first usage information associated with identification information that is the same as the identification information of the printing material container that is mounted in the printing apparatus, and executes error processing of the storage device of the printing material container, in a case where a relation between the usage information on the printing material container side and the first usage information does not satisfy a preset relation, wherein the second nonvolatile memory stores the identification information and the ink consumption information of each color of printing material containers that were mounted in the printing apparatus when the printing apparatus was last powered off or before a printing material container was replaced, and the printing apparatus controller, in a case where the identification information stored in the second nonvolatile memory and the identification information read from the storage device of the printing material container that is currently mounted do not match, and second usage information that is based on the ink consumption information of each color stored in the second nonvolatile memory satisfies a predetermined condition, performs processing for additionally writing the identification information and the second usage information that are stored in the second nonvolatile memory to the first nonvolatile memory.

2. The printing apparatus according to claim 1, wherein the printing apparatus controller, in a case where identification information that is the same as the identification information stored in the second nonvolatile memory is stored in the first nonvolatile memory, compares the second usage information with the first usage information associated with the same identification information stored in the first nonvolatile memory, and judges, based on a result of the comparison, whether to perform additional writing of the identification information and the second usage information that are stored in the second nonvolatile memory to the first nonvolatile memory.

3. The printing apparatus according to claim 1, wherein the first nonvolatile memory stores, as the first usage information, the ink consumption information of the color having the largest ink consumption among the ink consumption information of each color of the printing material container, and the second usage information that is based on the ink consumption information of each color stored in the second nonvolatile memory is the ink consumption information of the color having the largest ink consumption among the ink consumption information of each color.

4. The printing apparatus according to claim 1, wherein the first nonvolatile memory stores, as the first usage information, the ink consumption information of the color having the smallest ink consumption among the ink consumption information of each color of the printing material container, and the second usage information that is based on the ink consumption information of each color stored in the second nonvolatile memory is the ink consumption information of the color having the smallest ink consumption among the ink consumption information of each color.

5. The printing apparatus according to claim 1, wherein the first nonvolatile memory stores, as the first usage information, information regarding a total ink consumption of the ink consumptions of the colors of the printing material container, and the second usage information that is based on the ink consumption information of each color stored in the second nonvolatile memory is the information regarding the total ink consumption of the ink consumptions of the colors.

6. The printing apparatus according to claim 1, wherein the first nonvolatile memory stores, as the first usage information, color information of a color having the largest ink consumption and ink consumption information of the color among the ink consumption information of each color of the printing material container, and the second usage information that is based on the ink consumption information of each color stored in the second nonvolatile memory is the ink consumption information corresponding to the color of the color information stored in the first nonvolatile memory.

7. The printing apparatus according to claim 1, wherein the printing apparatus controller performs the error processing of the storage device of the printing material container before starting a printing operation, when returning from power saving mode, or after replacing a printing material container.

8. The printing apparatus according to claim 1, wherein the printing apparatus controller judges that the relation between the usage information on the printing material container side and the first usage information does not satisfy the preset relation in a case where the ink consumption that is based on the usage information on the printing material container side is smaller than the ink consumption that is based on the first usage information, and executes the error processing of the storage device.

9. The printing apparatus according to claim 8, wherein the printing apparatus controller compares the usage information on the printing material container side with the second usage information that is based on the ink consumption information of each color stored in the second nonvolatile memory, and executes the error processing of the storage device in a case where the ink consumption that is based on the usage information on the printing material container side is smaller than the ink consumption that is based on the second usage information.

10. A printing apparatus capable of mounting a multi-color integrated printing material container having a storage device that stores identification information of the printing material container and ink consumption information of each color, the printing apparatus comprising:

a first nonvolatile memory that stores the identification information of printing material containers mounted one or more times in the printing apparatus, and first usage information that is based on the ink consumption information of each color of the printing material containers; and a printing apparatus controller that controls print processing, wherein the printing apparatus controller compares usage information on the printing material container side that is based on the ink consumption information of each color read from the storage device of a printing material container that is mounted in the printing apparatus with the first usage information associated with identification information that is the same as the identification information of the printing material container that is mounted in the printing apparatus, and executes error processing of the storage device of the printing material container, in a case where a relation between the usage information on the printing material container side and the first usage information does not satisfy a preset relation, and wherein the printing apparatus controller performs writing for updating the ink consumption information of each color to the storage device of the printing material container at a higher frequency than a frequency at which the identification information and the usage information are written to the first nonvolatile memory.

11. A printing apparatus capable of mounting a multi-color integrated printing material container having a storage device that stores identification information of the printing material container and ink consumption information of each color, the printing apparatus comprising:

a first nonvolatile memory that stores the identification information of printing material containers mounted one or more times in the printing apparatus, and first usage information that is based on the ink consumption information of each color of the printing material containers; and a printing apparatus controller that controls print processing, wherein the printing apparatus controller compares usage information on the printing material container side that is based on the ink consumption information of each color read from the storage device of a printing material container that is mounted in the printing apparatus with the first usage information associated with identification information that is the same as the identification information of the printing material container that is mounted in the printing apparatus, and executes error processing of the storage device of the printing material container, in a case where a relation between the usage information on the printing material container side and the first usage information does not satisfy a preset relation, and wherein the first nonvolatile memory stores, as the first usage information, the ink consumption information of the color having the largest ink consumption among the ink consumption information of each color of the printing material container.

* * * * *